US006423227B1

(12) United States Patent
Allen et al.

(10) Patent No.: US 6,423,227 B1
(45) Date of Patent: Jul. 23, 2002

(54) MELTBLOWN YARN AND METHOD AND APPARATUS FOR MANUFACTURING

(75) Inventors: Martin A. Allen, Dawsonville, GA (US); Oldrich Jirsak, Liberec (CS)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/558,748

(22) Filed: Apr. 21, 2000

Related U.S. Application Data

(62) Division of application No. 09/096,895, filed on Jun. 12, 1998, now Pat. No. 6,054,216, which is a division of application No. 08/797,520, filed on Feb. 7, 1977, now Pat. No. 5,772,952.

(51) Int. Cl.[7] ..... B01D 29/05; B29C 53/14; B29C 55/30

(52) U.S. Cl. ..... 210/497.1; 425/66; 425/319; 425/321; 425/391; 57/57; 57/235; 57/31

(58) Field of Search ..... 210/494.1, 497.1, 210/505, 508, 500.27, 500.35, 500.41, 500.43; 264/DIG. 48; 425/66, 214, 319–322, 391; 57/235, 260, 31, 66, 336

(56) References Cited

U.S. PATENT DOCUMENTS

| | | | | |
|---|---|---|---|---|
| 523,061 | A | * | 7/1894 | Williams |
| 1,304,143 | A | * | 5/1919 | Barnum |
| 1,542,915 | A | * | 6/1925 | Sherman |
| 2,199,411 | A | * | 5/1940 | Lewis |
| 2,908,133 | A | * | 10/1959 | Brown |
| 3,496,716 | A | * | 2/1970 | Howard et al. |
| 3,595,245 | A | | 7/1971 | Buntin et al. ..... 131/269 |
| 3,615,995 | A | | 10/1971 | Buntin et al. ..... 156/161 |
| 3,684,415 | A | | 8/1972 | Buntin et al. ..... 425/71 |
| 3,978,185 | A | * | 8/1976 | Buntin et al. |
| 4,048,364 | A | * | 9/1977 | Harding et al. |
| 4,116,738 | A | * | 9/1978 | Pall |
| 4,130,983 | A | * | 12/1978 | Dammann et al. |
| 4,948,549 | A | | 8/1990 | Erdmannsdorfer et al. . 264/555 |
| 5,200,246 | A | | 4/1993 | Sabee ..... 428/110 |
| 5,219,633 | A | | 6/1993 | Sabee ..... 428/110 |
| 5,225,014 | A | | 7/1993 | Ogata et al. ..... 264/555 X |
| 5,356,581 | A | * | 10/1994 | Stuart |
| 5,409,642 | A | * | 4/1995 | Allen et al. |
| 5,503,782 | A | * | 4/1996 | Dyrud et al. |
| 5,555,716 | A | | 9/1996 | Dugan ..... 57/224 |
| 5,695,377 | A | * | 12/1997 | Triebes et al. |

FOREIGN PATENT DOCUMENTS

| | | | |
|---|---|---|---|
| JP | 2269973 | A * | 1/1990 |

* cited by examiner

*Primary Examiner*—Duane Smith
*Assistant Examiner*—Fred Prince
(74) *Attorney, Agent, or Firm*—Wood, Herron & Evans, L.L.P.

(57) ABSTRACT

A yarn of meltblown thermoplastic fibers is manufactured by meltblowing fibers onto a collector to form a thin web thereon, and continuously withdrawing and twisting the web into a generally circular yarn. In a preferred embodiment the yarn has a reinforcing cord disposed therein to lend strength thereto. The yarn is suited for many applications, including knitted and woven fabrics, and cartridge filters.

7 Claims, 2 Drawing Sheets

MELTBLOWN YARN AND METHOD AND APPARATUS FOR MANUFACTURING

This application is a divisional of application Ser. No. 09/096,895, filed Jun. 12, 1998 (now U.S. Pat. No. 6,054, 216) which is a divisional of application Ser. No. 08/797, 250, filed Feb. 7, 1977 (now U.S. Pat. No. 5,772,952).

BACKGROUND OF THE INVENTION

This invention relates to a yarn composed of ultrafine fibers of synthetic thermoplastic material. In one aspect, it relates to a meltblowing process and apparatus for manufacturing meltblown yarn. In another aspect, the invention relates to a fabric made from meltblown yarn. In a further aspect, the invention relates to a filter made from melt-blown yarn.

Meltblown fabrics manufactured from a synthetic thermoplastics have long been used in a variety of applications including filters, batting, fabrics for oil cleanup, absorbents such as those used in diapers and feminine hygiene absorbents, thermal insulation, and apparel and drapery for medical uses.

Meltblown materials fall in the general class of textiles referred to as nonwovens owing to the fact they comprise randomly oriented fibers made by entangling the fibers through mechanical means. The fiber entanglement, with or without some interfiber fusion, imparts integrity and strength to the fabric. The nonwoven fabric may be converted to a variety of end use products as mentioned above.

While it is true that meltblown material may be made as a roving, as described in U.S. Pat. No. 3,684,415, the apparatus for manufacturing the roving according to this process, is expensive, complicated and unreliable. The apparatus and process described in U.S. Pat. No. 3,684,415, have received very little, if any, commercial application.

Recently, efforts to make meltblown rods suitable for cigarettes filters resulted in several patents. See, for example, U.S. Pat. Nos. 4,961,415, 5,053,066, 5,509,430 and 5,531,235. Cigarette filter rods, however, are compact and substantially inflexible, making them totally unsatisfactory as yarns.

Conventional yarns are manufactured by twisting aligned monofilament threads of natural or synthetic fibers such as cottons, wool, nylon, polyesters and polyolefins. The filaments in the threads have a relatively large diameter (20 to 30 micron range) compared to melt-blown fibers (less than 10 microns). Because the threads are aligned during the twisting step of the process, the yarn does not possess texture or bulk (i.e. low bulk density). Conventional yarns are therefore further processed to reduce the bulk density and impart bulk to the yarn.

In addition to the traditional uses of yarn, as in fabric manufacturing, conventional yarns are now being used in a wide range of filtration application. One popular filter using yarns or threads is the wound cartridge filter. Typical material used in these yarns include polypropylene, fibrillated polypropylene, polyethylene cotton, rayon, polyester, nylon, and heat treated glass fibers.

Wound cartridge filters are made by winding the yarn on a core. This produces a depth filter with diamond shaped tunnels that get progressively smaller from the outer diameter to the core. Finer particles are progressively trapped as fluid travels to the center of the filter, allowing a much greater retention capacity than that with straight surface media of the same dimensions and porosity.

The choice of winding material for a particular wound cartridge, is dependent on several factors including chemical resistance and heat resistance requirements, FDA approval requirements, non-leaching requirements, as well as nominal and absolute particle retention requirements. The relatively large size (20–50 microns) of the standard fibers used to produce traditional yarns, limits the porosity of the yarns and hence limits the size of the particles that can be retained from the liquid or air wound filter.

Meltblown webs of polypropylene have also been used in cartridge fibers. The microsized fibers in meltblown webs provide high surface area, an important feature of filters. Cartridge filters that employ meltblown webs are disclosed in U.S. Pat. Nos. 5,340,479 and 5,409,642. Although meltblown webs have been used in cartridge filters, meltblown yarns have not. The industry recognized the importance of the meltblown microsized fibers (and attendant increased surface area of the filter media), but could not implement this feature in wound cartridges since yarns having microsized fibers (0.5 to 10 microns) were not available prior to the present invention.

SUMMARY OF THE INVENTION

The method of the present invention briefly involves forming a narrow meltblown web and twisting the web to convert the web into a yarn.

In a preferred embodiment of the present invention, the process involves continuously meltblowing microsized fibers of a thermoplastic onto a rotating collector, collecting the fibers on the collector as a narrow web of randomly entangled fibers, withdrawing the web, and pulling the web through a twister to convert the web into a yarn.

In another preferred embodiment, the method further includes the use of a reinforcing cord wherein the cord is positioned within the yarn, adding strength thereto.

The apparatus for manufacturing the yarn includes a narrow meltblowing die, a collector, a twister, and means (e.g. a godet) for pulling the meltblown material from the collector through the twister.

The yarns produced by the present invention possess unique properties making them ideal for a variety of end use products. The high bulk (i.e. low bulk density) of the yarn imparts a soft feel to fabrics made from such yarns as by weaving or knitting. A preferred use of the yarn is in filters, particularly in wound cartridge filters. The microsized fibers of the meltblown yarn provides high surface area and small pores for filtering fine particles from gas or liquid. Moreover, the yarns may be wound, alone or in combination with other materials, on the core of the cartridge filters to provide true depth filtration.

DESCRIPTION OF THE PREFERRED EMBODIMENTS

The present invention will be described with specific reference to the apparatus, followed by reference to the method, and finally with reference to the product (i.e. yarn, yarn fabric, and filter).

Figure 1:
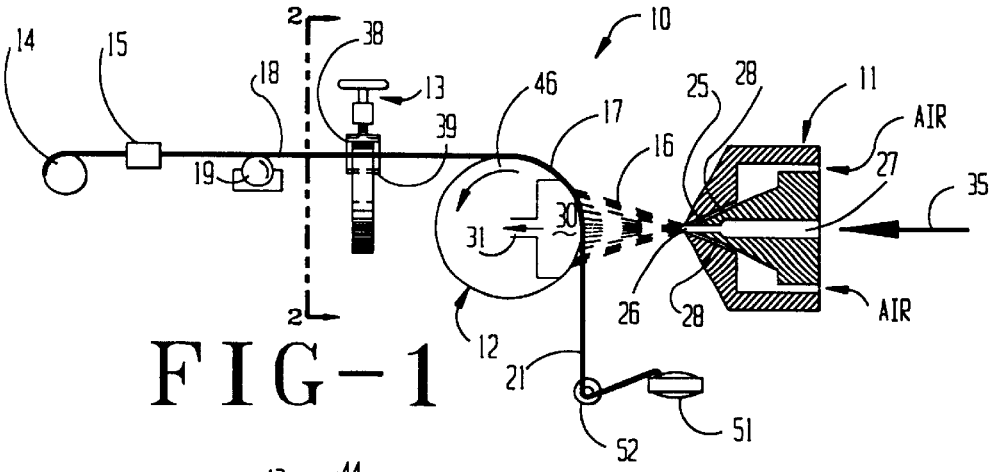
FIG. 1 is a schematic of the apparatus for manufacturing a meltblown yarn.

With reference to FIG. 1, the apparatus 10 of the present invention comprises:

(a) a meltblowing die 11 for extruding a row of thermoplastic fibers or filaments 16;

(b) a collector 12 for receiving the filaments 16 in the form of a web 17 of randomly entangled filaments;

(c) a twisting mechanism (twister 13) for converting the web 17 into a yarn 18;

(d) means (e.g. godet 15) for pulling the nonwoven web 17 from the collector 12 through the twister 13;

(e) a take-up spindle 14 for winding and storing the yarn 18; and (f) optionally, a lubricator 19.

In a preferred embodiment, the apparatus 10 will also include means for delivering a reinforcement thread (or cord 21), to the collector 12 in line with the discharge of die 11, wherein the meltblown filaments 16 are deposited thereon. In this embodiment, the twister 13 converts the flat web 17 into a yarn with the reinforcing cord 21 located generally at its center. Each of the principal components of the apparatus 10 is described in detail blow.

Meltblowing Die

As shown in FIG. 1, the meltblowing die 11 comprises a die tip 25 having a row of side-by-side orifices 26 formed therein, and converging air passages 28 flanking the row of orifices 26 so that as a molten polymer, fed by passage 27, is extruded through the orifices 26, the converging hot air sheets discharge from the air passages 28 and impart drag forces on the filaments 16, drawing them down from a relatively large size (in the order of 15 mils) to ultrafine size, ranging from 0.5 to 10 microns, preferably 1 to 8 microns, and most preferably 1 to 3 microns. While the meltblowing die 11 may take a variety of forms, a particularly useful meltblowing die is a commercial desk model manufactured by J&M Laboratories, Inc. under the trade designation Model DTMB.

By way of example, the dimensions and construction of the meltblowing die usable in the present invention may be as follows:

| | Broad Range | Preferred Range |
|---|---|---|
| Width (cm.) | 2.5–16 | 3.5–9 |
| Orifices/in. | 10–50 | 20–30 |
| Orifice size (in.) | 0.010–0.040 | 0.015 |
| Throughput (grams/hole) | 0.1–2 | 0.3–0.6 |
| Polymer Temperature (PP), (° C.) | 200–270 | 230–250 |
| Air Temperature, (° C.) | 220–300 | 268–275 |
| Air Rate (m/s) | 100–500 | 350–450 |
| Die Collector Distance (m) | 0.02–0.07 | 0.025–0.035 |

The die 11 will include means for delivery a molten polymer to the die shown by arrow 35 through passage 27 which generally will be a gear pump to carefully meter the amount of polymer delivered to the die. The line assembly will also include heaters (not shown) for heating the polymer and air to the desired temperatures. Since these components are well known in this arm and commercially available, they are not described herein. For more detailed description of the die, see U.S. Pat. No. 5,445,509, the disclosure of which is incorporated herein by reference.

Collector

The collector 12 may be in the form of a rotating screen drum, as illustrated in FIG. 1, or in the form of a continuous perforated conveyor belt or screen. The openings in the screen are selected to permit passage of the air, but not the filaments. (Note, the terms, "fibers" and "filaments" are used interchangeably herein.)

Underlying the area of fiber deposition is a vacuum compartment 30. As the air/fiber stream from the diell contact the screen 12, the fibers are deposited on the screen and the air passes into compartment 30. Air is withdrawn from compartment 30 through opening 31. The construction and operation of the collector 12 for meltblowing operations are well known in the art.

The web collected on the collector will have a width preferably not in excess of 9 cm. and a basis weight in the range of 1 to 20 gr./m$^2$, preferably 3 to 10 gr./m$^2$, and most preferably 3 to 6 gr./m$^2$.

Twister Mechanism

As indicated above, the twister 13 converts the flat web 17 (See FIGS. 2 and 5) into a generally circular yarn strand 18. A variety of devices may be used for this purpose, including twisting or rolling mechanisms.

Figure 2:
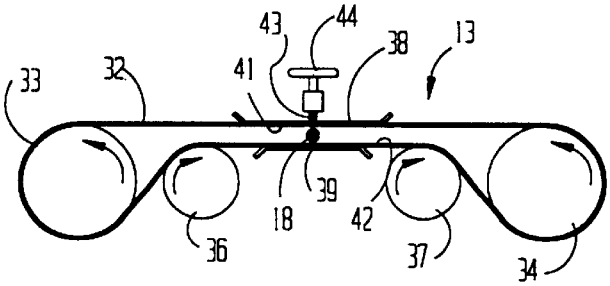
FIG. 2 is an enlarged sectional view (shown in schematic) of the twisting mechanism shown in FIG. 1, with the cutting plane taken along line 2—2.

The preferred twister 13 is illustrated in FIG. 2 as comprising a continuous belt 32 trained around and end rollers 33 and 34 (one of which is driven) and guide rollers 36 and 37. The top run or portion 41 of the belt 32 passes under plate 38 and the bottom run or portion 42 of belt 32 passes on top of stationary plate 39. Connector bar 43 is secured to the top of plate 38 and includes means for adjustable moving plate 38 toward and away from stationary plate 39. A threaded connection between handle 44 and bar 43 may be used for this purpose. Thus, as belt runs 41 and 42 move in opposite directions between plates 38 and 39, the vertical space between the counter-moving belt runs may be adjusted. Adjustment will depend on the size of yarn 18. The adjustment, however, should provide a separation of belt runs 41 and 42 in the range of 0.01 to 0.7 cm.

Figure 4:
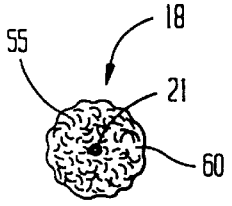
FIG. 4 is an enlarged cross sectional view of the meltblown yarn made in accordance with the present invention.
Figure 6:
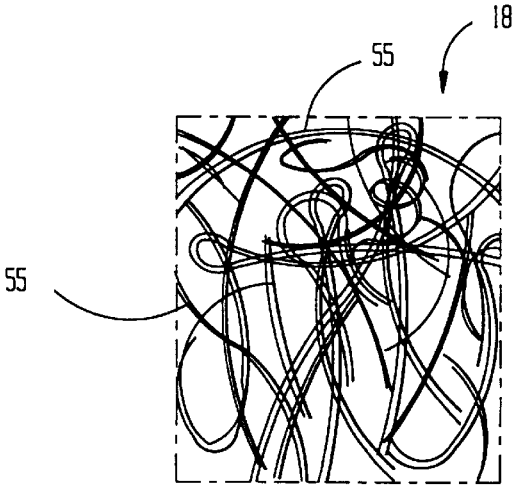
FIG. 6 is a magnified side portion of a yarn of the present invention, illustrating the random entanglement of the microsized meltblown fibers.
Figure 5:
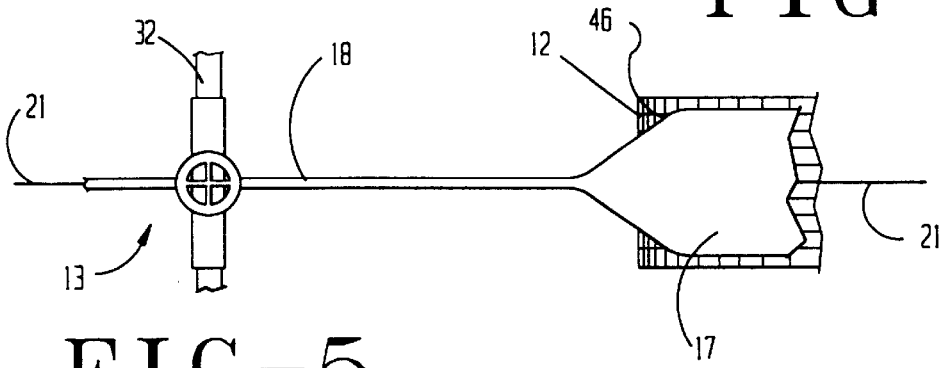
FIG. 5 is a top plan view of a portion of the apparatus shown in FIG. 1.

In commencing the twisting operations, the web 17 is initially passed between upper and lower belt portions 41 and 42 with belt 32 stationary. However, upon driving the belt 32 in the counter-clockwise direction as viewed in FIG. 2, the contact of upper and lower belt runs 41 and 42 on web 17 twists or rolls the web 17 into a circular yarn 18 shown in FIG. 4. During normal operations, the transition from web 17 to yarn 18 occurs between the web 17 release (as at 46) from the collector 12 and the twister 13 as best seen in FIG. 5. Of course, it is to be understood that automatic adjustment of the plate separation may be employed to provide a precise and variable adjustment.

The belt 32 may be made of any material that offers friction with the yarn to effect the twisting or rolling effect thereon. Such materials include rubber and rubber-like or plastic materials.

The confronting surface of plates 38 and 39 should present little resistance to the moving belt 32 in contact therewith. Polished steel or Teflon surfaces may be used.

Other Components

In order to maintain a tension on the yarn 18 and the web 17 between the web release 46 from the collector 12 and passage through the twister 13, a godet 15 is provided immediately upstream of the take up spindle 14. The godet is conventional, comprising two rollers, one of which is driven slightly faster than the other to maintain a tension (from 5 to 10 grams) on the upstream yarn 18.

A lubricating wheel 19 may also be provided in the apparatus 20. The lubricant increases the processability of the yarn to include those commonly used for polypropylene spun yarns.

The wind-up spindle 14 can be any of those used presently in the manufacture of threads or yarns.

Reinforcing Thread or Cord

Figure 3:
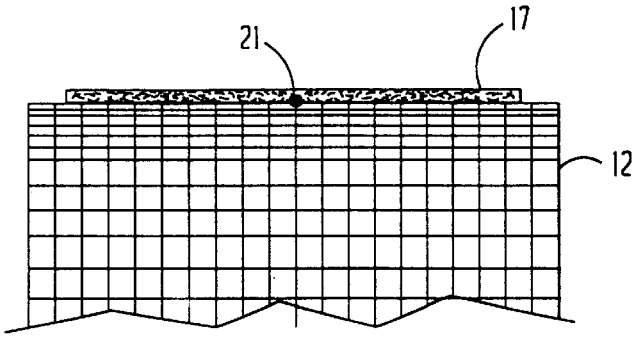
FIG. 3 is an enlarged cross sectional view of the meltblown web as laid down on the collector.

In order to impart additional tensile strength to the yarn 18, it is preferred to use a reinforcing cord 21 dispensed from a spindle 51. For convenience, the term "cord" will refer to any continuous thread or strand. The cord 21 passes around guide and brake 52 and around a circumferential portion of screen collector 12, through the twister 13, to the godet 15, and finally to the takeup spindle 14. The cord 21 is positioned on the surface of the screen 12 at about the midpoint of the web 17 cross direction so that the filaments 16 extruded from die 11 are deposited on the screen 12 and cord 21 as shown in FIG. 3.

The reinforcing cord 21 may be made of mono or multifilament synthetics such as nylon, polyester, polyolefins (polypropylene and polyethylene) and the like. Also usable are twines of cotton, wool, and other natural fibers. In some applications, the cord 21 may be made of a material that improves the filtration process. For example, active carbon fibers in the form of central cord 21 may improve the filtration of certain fluids. The cord 21 may include a mixture of fibers selected from synthetics, natural and carbon fibers. The fibers may also be treated with surfactants or other agents to improve filtration.

Operation

In the preferred operation of the present invention, the reinforcing cord 21 will be dispensed from spindle 51, trained around guide and brake 52, passing at the center of the collection area of the collector 12, through twister 13, through godet 15, and finally secured to the take-up spindle 14. The godet 15 is operated to maintain a small tension on the cord 21 (e.g. 20 grams) to pull the cord 21 through the twister 13. The filaments 16 from die 11 are deposited on the collector area, covering cord 21. This forms a flat narrow web 17 thereon (see FIG. 3). The godet 15 initially pulls the cord 21 and web 17 through the twister 13. The plates 38 and 39 are adjusted to cause the counter moving belt runs 41 and 42 to contact the web 17 on opposite sides. This twists or rolls the web 17 into a circular yarn 18 with the cord 21 positioned at about its center as illustrated in FIG. 4. The meltblown fibers thus provide a sheath around the cord 21. As the yarn 18 is formed, some minor adjustment of the plates 38 and 39 may be required to compensate for the increased vertical dimension of the yarn 18 in relation to the web 17. During normal operations, the yarn 18 will commence forming immediately upon leaving the collector screen 12 and continue to form until it leaves the twister 13. The yarn 18 passes through the lubricator, if used, the godet 15 and is wound on spindle 14.

If desired, the yarn 18 can be made without the reinforcing cord 21. During the yarn forming operation wherein the yarn extends from collector 12 to the godet 15, the feeding of the reinforcing cord 21 is discontinued. At this stage of the operation, the yarn 18 itself has sufficient integrity and tensile strength to permit continued operation as described without the cord 21.

The speed relationship between the collector 12, take up spindle 14, and twister belt 32, will depend upon several factors including the type of meltblown resin used, quality, and properties of the yarn, and contemplated end use. The following speeds, however, have been demonstrated:

| | Collector Speed (m/sec) | Yarn Take up Speed (m/sec) | Twister Belt Speed (m/sec) |
|---|---|---|---|
| First Set | 3.0 | 3.3 | 6.7 |
| Second Set | 6.0 | 6.6 | 14.8 |

Good results have been obtained with twister belt speeds of about twice that of yarn take up speed. The rate of belt speed to yarn speed, however, may range from about 1.5:1 to about 3:1.

The twister imparts a spiral shape to the web 17, converting it into yarn 18. Each spiral makes a 360° loop from about 0.001 to 0.01 meters of the yarn. In converting the web to yarn, twisting is preferred over merely rolling because twisting produces a more integral and cohesive yarn, which resists unraveling.

Properties and Yarn Characteristics

The yarn may have the follow properties:

| | Broad Range | Preferred Range | Most Pref. Range |
|---|---|---|---|
| Yarn diameter | 0.5 to 5 mm | 1 to 3 mm | 2 to 3 mm |
| Meltblown fiber size | 0.3–10 microns | 0.5–5 microns | 1–3 microns |
| Reinforcing cord diameter/yarn diameter ratio | 0–90% | 1–75% | 10–50% |
| Yarn bulk density | 10 to 100 kg/m$^3$ | 20 to 70 kg/m$^3$ | 30 to 60 kg/m$^3$ |
| Yarn tensile strength | | | |
| with reinforcing cord | 1 to 3 CN/dtex | | |
| without reinforcing cord | 0.1 to 1 CN/dtex | | |

A unique property of the meltblown yarn of the present invention is the disposition of the meltblown micro fibers. Yarns made by conventional yarn making processes comprise twisted filaments that extend generally in the machine direction (i.e. along the length of the yarn). The meltblown yarn of the present invention comprise randomly entangled meltblown fibers 55. FIG. 5 is a drawing of a microphotograph (magnification of 500×) of the surface of a meltblown yarn made from polypropylene. As can be seen, the meltblown fibers 55 are not oriented in any particular direction, but are random in the x,y, and z directions. This results in a yarn of low bulk density, exhibiting soft hand and exceptional flexibility.

The thermoplastics usable in the present inventions are any of the wide variety of resins presently used in meltblowing. These include ethylene and propylene homopolymers and copolymers. Specific thermoplastics includes ethylene acrylic copolymers, nylon, polyamides, polyesters, polystyrene, poly (methyl methacrylate), polytetraflurochlorethylene (PTFE), ethylenechlorotrifluoroethylene (ECTFE), polyurethanes, polycarbonates,siliconesulfide, and poly (ethylene terephthalate), pitch, and blends of the above. The preferred resin is polypropylene. The above list is not intended to be limiting, as new and improved meltblowing thermoplastic resins continue to be developed. Also usable are the elastomeric thermoplastics such as those disclosed in U.S. Pat. No. 4,804,577, the disclosure of which is incorporated herein by reference.

Uses of the Meltblown Yarns

Because of its low bulk density, strength, and flexibility, the meltblown yarn 18 can be used in the manufacture of wovens and knitted fabrics. Woven or knitted fabrics from yarns of the present invention exhibit excellent strength. These fabrics exhibit good hand, softness, warmth, and flexibility and essentially no shrinkability, making them ideal for apparel, disposable wipes and knitted and woven filters. As noted above the meltblown yarn is particularly suited for cartridge filters.

Figure 7:
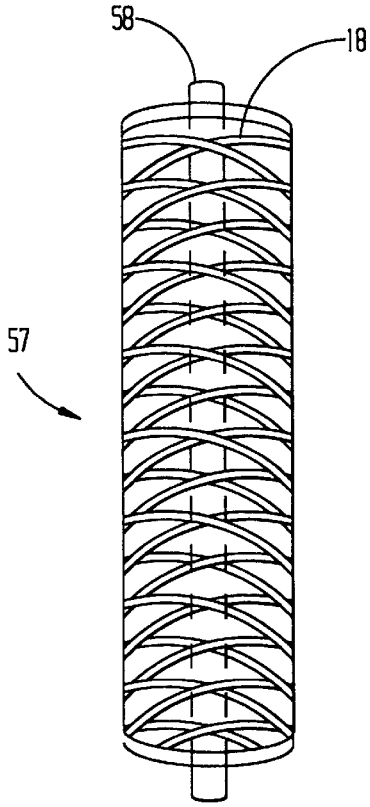
FIG. 7 is a side elevation view of a cartridge filter wound with meltblown yarn.

The microsized fibers of the yarn 18 present large surface area enhancing their use as filters. The filters may be in the form of layered filters (woven or knitted yarn), which can be flat or pleated. A particularly preferred filter is a wound cartridge filter 57 shown in FIG. 7 wherein the yarn 18 is wound on a core 58. The yarn 18 may be straight wound or wound in a spiral pattern (screw thread), producing a depth filter. The core 58 of the wound filter can be selected from a variety of any sizes or types that are currently used in wound cartridge filters. Moreover, the filter may include other radial zones of different materials such as layers of active charcoal impregnation.

EXAMPLES

Example I

Polypropylene polymer (Exxon's standard MB grade PP) was processed by a meltblowing unit with the 0.1 m wide spinning die into fibers of 1 micrometer diameter (average). The fibers were collected on the surface of collector drum placed at a distance of 0.04 m (15.7 in.) from the die. The material was continuously fed through the twisting unit placed at a distance of 1.5 m from the collector drum and twisted into a yarn. The yarn was then wound up on the bobbin. The yarn had a diameter of about 4 mm. The web had a basis weight of about 4 g/m$^2$, and the yarn had a bulk density of about 30 kg/m$^3$. The meltblowing die Model was purchased from J&M Laboratories, Inc. and operated per J&M specifications. The operating conditions were as follows:

| | |
|---|---|
| Collector drum speed | 83 m/min |
| Yarn line speed | 30 m/min |
| Twister belt speed | 320 m/min |
| Tension on yarn | 0.06 N |

Example II

Meltblown fibers of the average diameter 1.2 micrometers were produced as in Example I. A thread of rayon staple 10 (diameter of 1.2 mm) was lead from the bobbin onto the collecting surface of the collector drum. The material was then processed by a twisting unit as in Example I. Thus the composite yarn was produced consisting of 1.2 mm diameter reinforcing core placed at the yarn axis. The yarn had a diameter of 4.2 mm.

Example III

In the process as in Example II, a polyamide multifilament of 0.5 mm diameter was lead onto collecting surface of the collector drum. The composite yarn was produced consisting of 0.8 mm diameter reinforcing core at the yarn axis. The yarn had a diameter of 4.1 mm.

Example IV

Knitted and woven fabrics were produced of the yarns from the Examples I, II and III. The fabrics were characterized as soft, flexible, and strong.

SUMMARY

The present invention contemplates the following improvements which are specifically and claimed herein:

(a) Process for manufacturing a meltblown yarn.

(b) Apparatus for manufacturing a meltblown yarn.

(c) A meltblown yarn, and (d) A wound cartridge filter.

What is claimed is:

1. An apparatus for manufacturing yarn from meltblown fibers, comprising:

(a) a meltblowing die having a row of orifices;

(b) means for delivering a thermoplastic melt to said die to extrude a row of fibers from said orifices;

(c) a collector positioned to receive and collect the fibers thereon as a web;

(d) a twister;

(e) means for continuously withdrawing the web collected on said collector and pulling the web through said twister, thereby twisting the web into the yarn; and (f) a take up spindle including means to wind the yarn thereon.

2. A filter comprising:

(a) a hollow core, and (b) a yarn wound to form an annular filter zone around the core, said yarn including an interior cord and a generally cylindrically-shaped sheath of meltblown thermoplastic fibers surrounding the cord in a twisted configuration, said meltblown fibers being randomly entangled and having an average fiber diameter of 0.3 to 10 microns.

3. An apparatus for manufacturing yarn from meltblown fibers, comprising:

a meltblowing die having a plurality of liquid discharge passages for receiving and discharging a thermoplastic melt as a plurality of fibers and respective process air discharge passages positioned on opposite sides of said liquid discharge passages for attenuating the plurality of fibers;

a moving collector positioned to receive and collect the plurality of fibers into a web;

a twisting device positioned to receive the web and configured to twist the web into the yarn; and a tensioning device positioned downstream of said twisting device and operating to maintain a tension on the yarn at said twisting device.

4. The apparatus of claim 3, wherein said twisting device further comprises an endless, rotatable belt configured to contact opposite sides of the web, said belt being rotated to twist the web into the yarn.

5. An apparatus for manufacturing reinforced yarn from meltblown fibers, comprising:

a meltblowing die having a plurality of liquid discharge passages for receiving and discharging a thermoplastic melt as a plurality of fibers and respective process air discharge passages positioned on opposite sides of said liquid discharge passages for attenuating the plurality of fibers;

a dispenser operative to dispense a reinforcing cord:

a moving collector positioned to receive and collect the plurality of fibers into a web with the web lying adjacent to the reinforcing cord dispensed from said dispenser; and a twisting device positioned to receive the web and the reinforcing cord and operative to engage and twist the web around the reinforcing cord to form the reinforced yarn.

6. The apparatus of claim 5, wherein said twisting device further comprises an endless rotatable belt configured to contact opposite sides of the web, said belt being rotated to twist the web into the reinforced yarn.

7. The apparatus of claim 6, further comprising:

a tensioning device positioned downstream of said twisting device and operating to maintain tension on the reinforced yarn at said twisting device.

* * * * *